US012011066B2

(12) United States Patent
Rhodes

(10) Patent No.: US 12,011,066 B2
(45) Date of Patent: Jun. 18, 2024

(54) SHOE SLIDE WITH PODIATRIC ELEMENTS

(71) Applicant: Richard L. Rhodes, Stamford, CT (US)

(72) Inventor: Richard L. Rhodes, Stamford, CT (US)

( * ) Notice: Subject to any disclaimer, the term of this patent is extended or adjusted under 35 U.S.C. 154(b) by 164 days.

(21) Appl. No.: 17/807,130

(22) Filed: Jun. 15, 2022

(65) Prior Publication Data

US 2022/0395048 A1 Dec. 15, 2022

Related U.S. Application Data

(60) Provisional application No. 63/202,537, filed on Jun. 15, 2021.

(51) Int. Cl.

| | |
|---|---|
| ***A43B 7/14*** | (2022.01) |
| ***A43B 3/12*** | (2006.01) |
| ***A43B 7/1405*** | (2022.01) |
| ***A43B 7/144*** | (2022.01) |

(52) U.S. Cl.

CPC ..... *A43B 3/128* (2013.01); *A43B 3/12* (2013.01); *A43B 7/1405* (2013.01); *A43B 7/144* (2013.01)

(58) Field of Classification Search

CPC ... A43B 7/1405; A43B 7/1415; A43B 7/1425; A43B 7/144; A43B 3/12; A43B 7/14

USPC ..... 36/43

See application file for complete search history.

(56) References Cited

U.S. PATENT DOCUMENTS

| | | | | | |
|---|---|---|---|---|---|
| 1,675,711 | A | * | 7/1928 | Jones | A43B 7/22 36/140 |
| 1,741,419 | A | * | 12/1929 | Jones | A43B 7/14 36/43 |
| 1,746,002 | A | * | 2/1930 | Lobel | A43B 7/142 36/180 |
| 1,976,441 | A | * | 10/1934 | Feldman | A43B 7/144 36/173 |
| 2,148,974 | A | * | 2/1939 | Wysowski | A43B 7/1445 36/164 |
| 2,157,026 | A | * | 5/1939 | Sochor | A43B 7/24 36/80 |
| 2,486,653 | A | * | 11/1949 | Hukill | A43B 7/1445 36/141 |
| 2,510,654 | A | * | 6/1950 | Pepin | A43B 7/226 36/94 |
| 2,546,408 | A | * | 3/1951 | Riggs | A43B 7/22 36/43 |

(Continued)

*Primary Examiner* — Marie D Bays

(74) *Attorney, Agent, or Firm* — Andrew F. Young; NOLTE LACKENBACH SIEGEL

(57) ABSTRACT

A shoe slide that includes a footbed having a forefoot area with a top edge, a hindfoot portion with a bottom edge, and a footbed surface. A foam footbed liner is disposed atop the footbed surface, the foam footbed liner having an upper surface. A metatarsal pad in the forefoot area of the footbed protrudes above the surface of the footbed liner and is dimensioned such that when the shoe slide is worn the metatarsal pad engages and applies pressure to the wearer's plantar fascial near the proximal phalanges of the toes at the metatarsophalangeal joints. The shoe slide also includes a raised rubber protrusion in the hindfoot area of the footbed positioned and dimensioned such that when the shoe slide is worn the raised rubber protrusion engages and applies pressure to the wearer's plantar fascia near the calcaneal tubercle.

14 Claims, 6 Drawing Sheets

(56) References Cited

U.S. PATENT DOCUMENTS

| | | | | | |
|---|---|---|---|---|---|
| 2,613,455 | A * | 10/1952 | Amico | A43B 7/1415 | 36/155 |
| 2,680,919 | A * | 6/1954 | Riggs | A43B 7/1425 | 36/155 |
| 2,863,231 | A * | 12/1958 | Jones | A43B 7/14 | 36/174 |
| 3,063,458 | A * | 11/1962 | Scholl | A43B 3/128 | D2/918 |
| 4,109,661 | A * | 8/1978 | Fukuoka | A43B 7/145 | 36/141 |
| 4,932,141 | A * | 6/1990 | Hones | A43B 13/40 | 36/43 |
| 5,784,811 | A * | 7/1998 | Mauch | A43B 7/1425 | 36/43 |
| 5,787,608 | A * | 8/1998 | Greenawalt | A61F 5/14 | 36/169 |
| 6,163,983 | A * | 12/2000 | Van Niekerk | A43B 7/144 | 36/35 R |
| 10,609,981 | B1 * | 4/2020 | Phinney | A43B 7/149 | |
| 2004/0103558 | A1 * | 6/2004 | Everz | A43B 7/146 | 36/43 |
| 2009/0205222 | A1 * | 8/2009 | McLinden | A43B 17/02 | 36/28 |
| 2014/0259755 | A1 * | 9/2014 | Tsai | A43B 7/1415 | 36/43 |
| 2015/0026998 | A1 * | 1/2015 | Lin | A43B 17/006 | 36/44 |
| 2016/0227879 | A1 * | 8/2016 | Haselaars | A43B 13/37 | |
| 2016/0235156 | A1 * | 8/2016 | Stumpf | A43B 13/181 | |
| 2017/0006961 | A1 * | 1/2017 | Pedersen | A43B 17/023 | |
| 2022/0183419 | A1 * | 6/2022 | Pham | A43B 17/006 | |

* cited by examiner

SHOE SLIDE WITH PODIATRIC ELEMENTS

CROSS REFERENCES TO RELATED APPLICATIONS

The present application claims the benefit of the filing date of U.S. Provisional Patent Application Ser. No. 63/202,537, filed Jun. 15, 2021 (Jun. 15, 2021), which is incorporated in its entirety by reference herein.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION BY REFERENCE OF MATERIAL SUBMITTED ON A COMPACT DISC

Not applicable.

SEQUENCE LISTING

Not applicable.

BACKGROUND OF THE INVENTION

Field of the Invention

The present invention relates generally to footwear, specifically and especially including shoes, and more particularly to footwear configured to mobilize the thick, web-like plantar fascia at both the origin and insertion of the ligament.

Background Discussion

Whether through specific physical exertion or everyday wear and tear, a growing number of amateur athletes and working professionals across all age groups and backgrounds suffer from various forms of foot pain including overuse injuries specifically related to the plantar fascia ligament. The vast majority simply do not have the time, money, or expertise to take preventive or corrective measures to make sure their feet are healthy and pain-free.

Referring to FIGS. 1-2, there is shown a lower rear perspective view featuring the bones and plantar fascia in a human foot (FIG. 1), and the bones of the foot in a side view in elevation (FIG. 2). Plantar fasciitis is very common cause of heel pain. It is caused by inflammation of the plantar fascia, which is a thick band of tissue on the underside 1 of the foot 2 at the fore of the heel 3. The plantar fascia 4 originates from the medial tubercle 5 of the calcaneus and inserts into the transverse ligaments 6 of the metatarsal heads 7, dividing into 5 digital bands 8. Though it is common, the cause of the pain from plantar fasciitis is unknown. It may be substantial, resulting in the alteration of daily activities, and the locus of pain is slightly distal to the medial tubercle near the plantar surface.

Most current footwear products attempting to prevent or relieve foot pain fail to address recurring problems, such as plantar fasciitis and morton's neuroma, by over-emphasizing cushioning and/or stabilization. At the same time, therapeutically effective professional massage and physical training solutions are costly and time-consuming. According to the American Podiatric Medical Association, 77% of adults in the United States ages 18 and older claim to experience recurring foot pain, but less than 30% seek professional help. The painful truth about recurring foot pain is that relief often requires weeks or even months of rest, rehabilitation, and possibly surgery followed by prolonged rehabilitation. Ultimately, the best way to address recurring foot pain is to actively prevent it in the first place.

Currently there are a number of sandals and slides in the marketplace from leading manufacturers that feature contoured cushioned footbeds, basic arch support, and other largely cosmetic features, including EVA foam and/or rubber pads and/or nodules designed to "massage" the underside of the foot. A widely-available technological development includes inserts and insoles featuring contoured, cushioned, and/or "stabilizing" attributes that serve to secure, support, and/or stretch the underside of the foot, typically the arch.

However, to the knowledge of the present inventor, there are no known shoes in the marketplace featuring podiatric elements on the footbed surface that mobilize the plantar fascia at both its origin and insertion points.

BRIEF SUMMARY OF THE INVENTION

It is a principal object of the present invention to provide a new and improved pair of shoes having podiatric elements that proactively mobilize the thick, web-like plantar fascia at both the origin and insertion of the ligament.

Unlike prior art solutions that serve only to cushion, stabilize, and/or "massage" the underside of the foot, the shoe slide of the present invention is specifically designed to mobilize and relax, stretch, and reduce impaction of the soft tissues of the feet through ordinary everyday use of the footwear. At the same time, the invention mitigates and potentially obviates time-consuming physical therapy exercises that are all too often poorly performed, forgotten, or ignored by users.

The invention's unique technological principle involves applying targeted pressure stimulation to the underside of the foot while relying on an individual's body weight and natural movements to mobilize targeted muscle groups and related connective tissue. In doing so, the invention lowers the risk of injury associated with artificial external pressures issued by weight and core/balance training that may strain targeted muscles and/or joints. In conjunction with a healthy and safe training and recovery regimen, the invention automatically adjusts with improvements to a user's weight to continually mobilize and condition feet.

The invention is specifically designed to help prevent recurring foot pain, including conditions like plantar fasciitis and morton's neuroma. Through targeted pressure stimulation along the underside of the foot, this invention mobilizes muscles and connective tissue with every step. Recommended use includes wearing before and/or after extended activity involving feet, including cross-training, running, standing, swimming, and cycling. Over the first few days of use, users should work their way up to wearing 15-20 minutes once or twice daily.

The disclosed invention is an article of footwear with uniquely shaped, sized, and positioned podiatric elements that proactively mobilize the thick, web-like plantar fascia at both the origin and insertion of the ligament. The specifications set out in the detailed description below for the heel cup, rounded rubber protrusion, and raised metatarsal pad, preventively stimulate (repeatedly stretch and release) the origin of the plantar fascia at the calcaneal tubercle and at its insertion point at the proximal phalanges of the toes at the metatarsophalangeal joint, which are most often injured and/or damaged from overuse injuries.

BRIEF DESCRIPTION OF SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
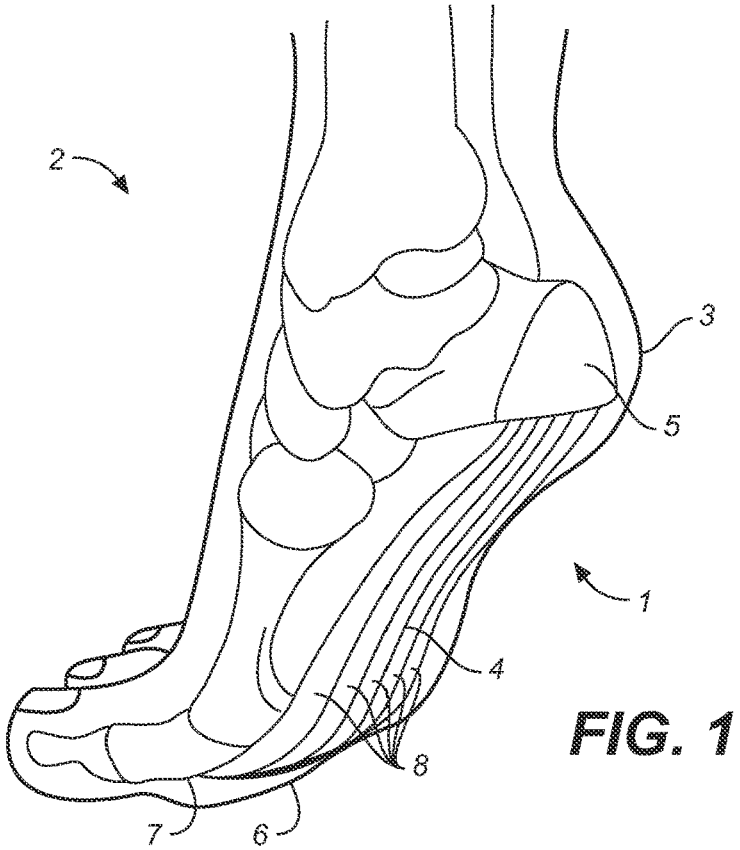
FIG. 1 is an inferior and posterior perspective view of a right human foot, featuring the plantar fascia ligament and its attachments at the medial tubercle of the calcaneus and the transverse ligaments at the metatarsal heads.
Figure 2:
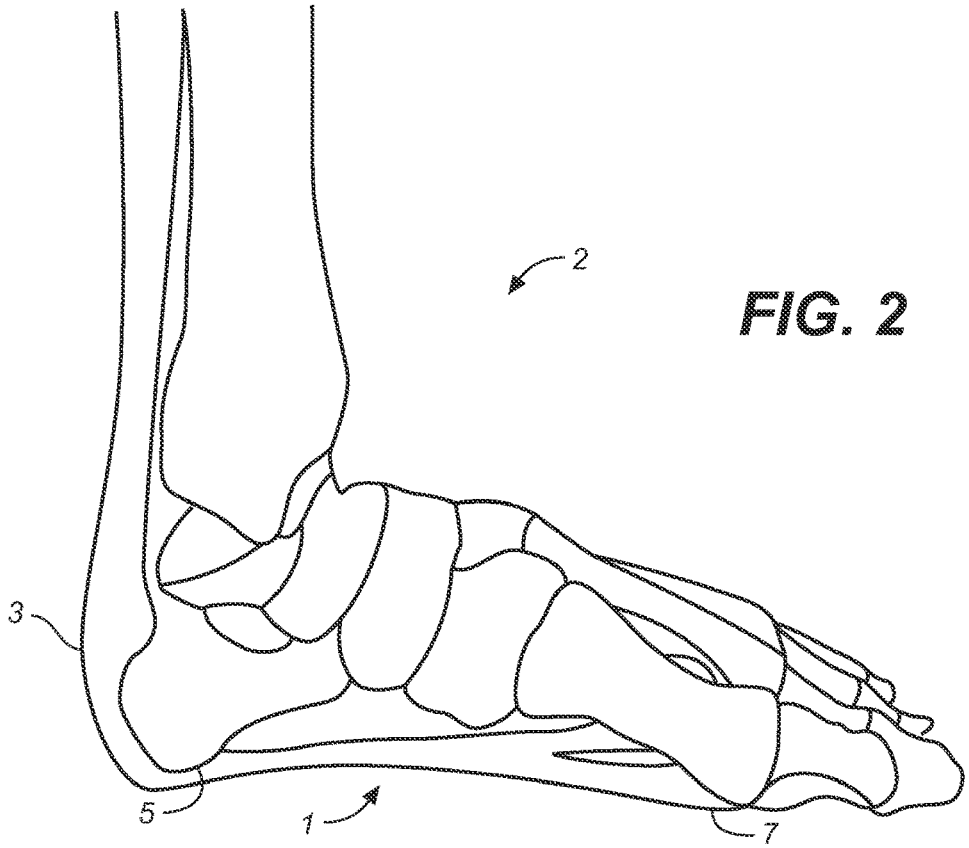
FIG. 2 is a medial side view in elevation showing the skeletal anatomy of a human foot, also featuring the Achilles tendon and plantar fascia ligament

Referring now to FIGS. 3A through 6, wherein like reference numerals refer to like components in the various views, there is illustrated therein a new and improved shoe slide having podiatric elements that mobilize the plantar fascia, generally denominated 10 herein.

Figure 3A:
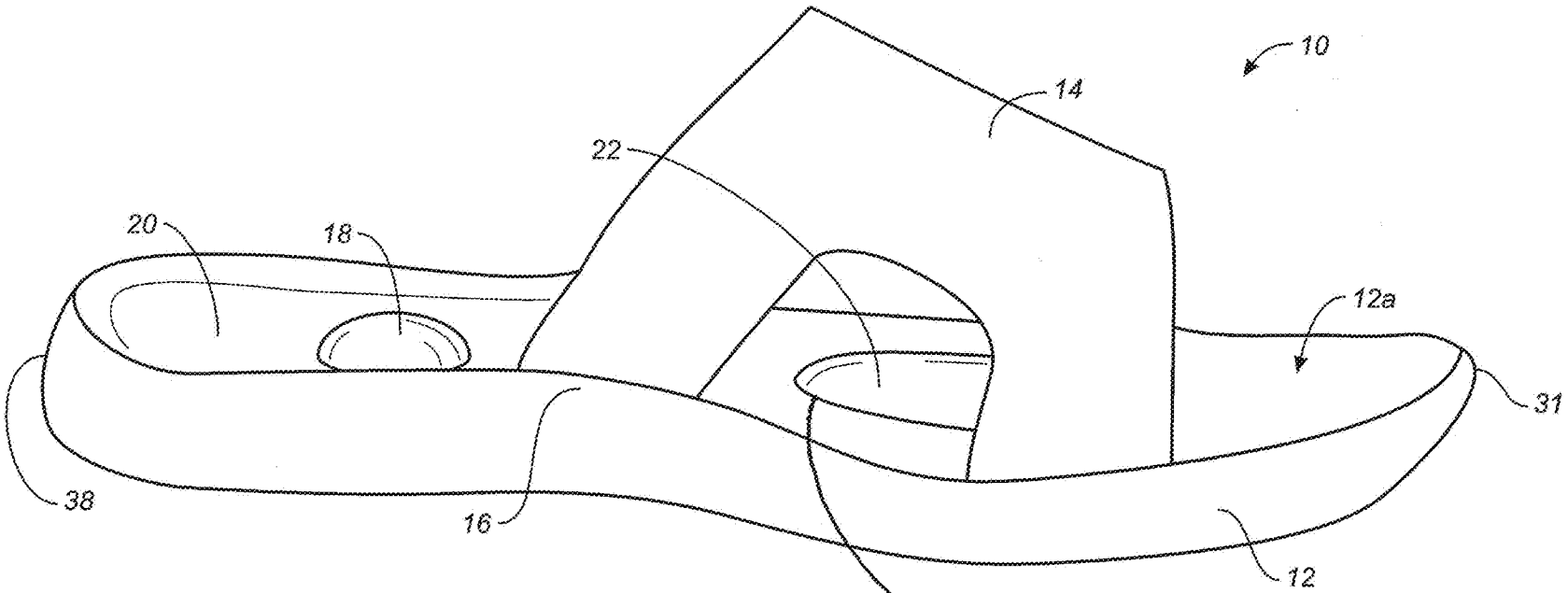
FIG. 3A is an upper right side perspective view of the right foot shoe of the inventive shoe slide of the present invention.
Figure 3B:
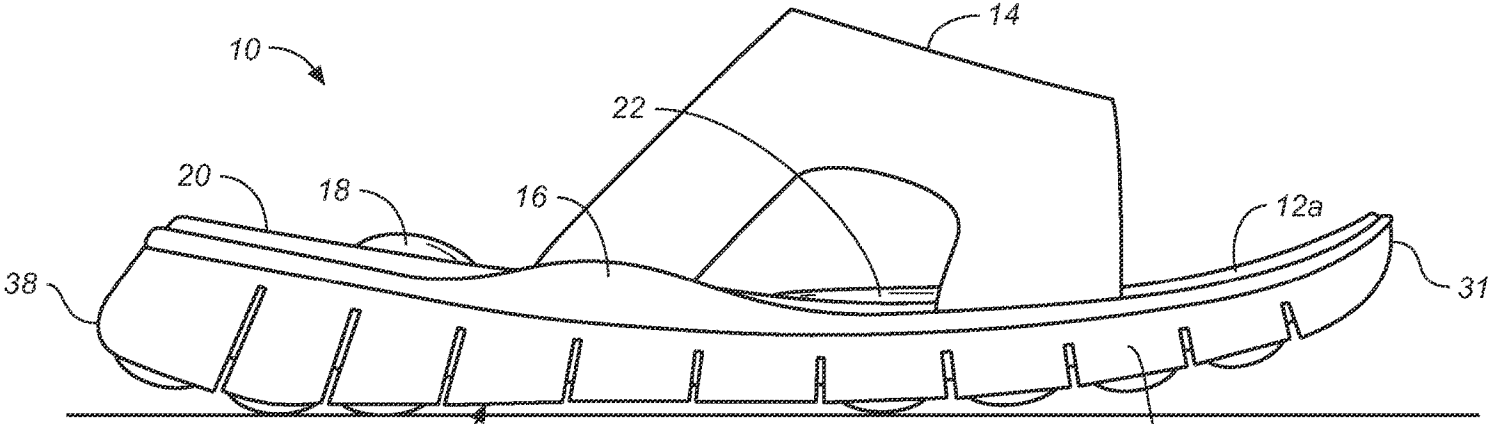
FIG. 3B is a side view in elevation of the left shoe.
Figure 3C:
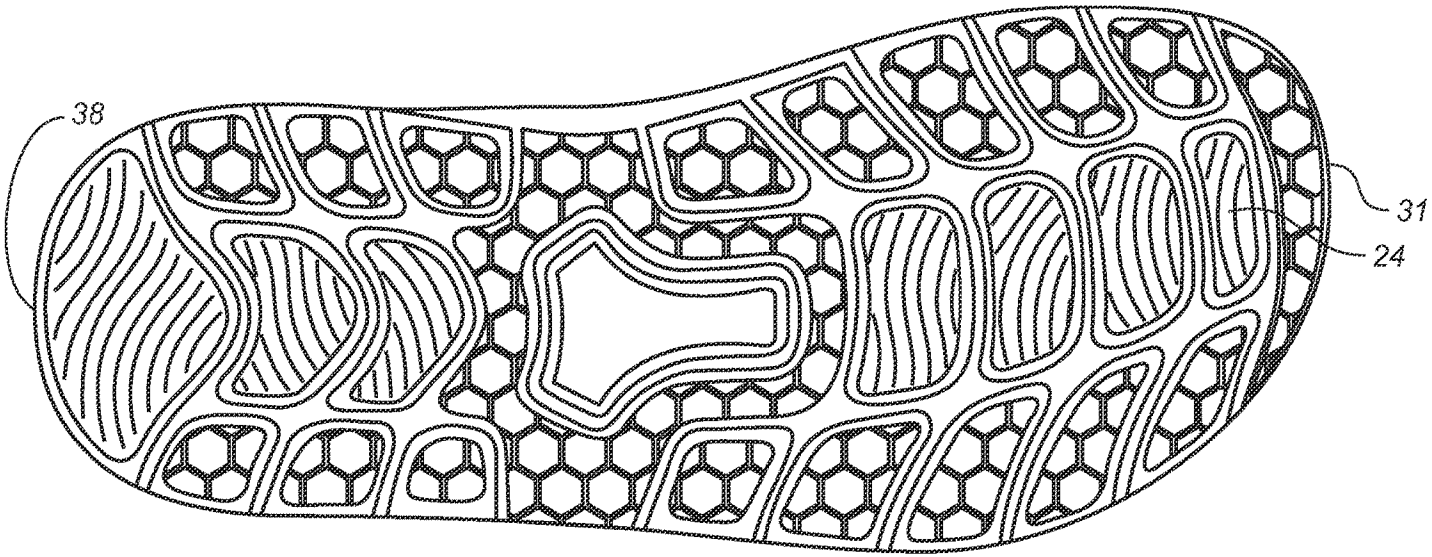
FIG. 3C is a bottom plan view of the outsole thereof.

Looking at FIGS. 3A-3C, the shoe slide 10 includes a firm two-ply ethylene-vinyl acetate (EVA) foam footbed 12 with an EVA footbed liner 12*a* that stabilizes and cushions the foot, while a strap 14 slides over the dorsum of the foot to secure the slide in place. The strap may be a two-ply breathable mesh strap, woven strap, solid strap, or any of a number of suitable strap configurations. As users step and/or stand, the heel cup squares the foot (1) over a raised EVA foam arch 16, which moderately stretches the plantar fascia (arch band); (2) a rounded rubber protrusion 18 at the fore of the heel or heel cup 20, effectively mobilizes the plantar fascia (arch band) at its connection point; and (3) a raised EVA metatarsal pad 22 effectively imparts a force under the metatarsal arch to spread the metatarsal bones, reducing impaction between the toes.

While users may experience varying degrees of pressure at the heel and under the metatarsal bones and the toes, similar to a deep-tissue massage, to best utilize the tissue stretch and stimulation induced, the invention is optimally used by wearing the slides before and/or after any extended activity for 15-20 minutes at least once a day. Initially, users may need to wear the slides a few minutes each day as they become more comfortable with the sensation, specifically at the forefoot and arch (where it attaches to the heel bone), and as their feet begin to demonstrate more mobility.

Through targeted pressure stimulation along the underside of the foot, the shoe slide invention mobilizes muscles and connective tissue with every step. Recommended use includes wearing before and/or after extended activity involving high impact footwork, including cross-training, running, standing, cycling, even swimming.

The rounded rubber protrusion 18 and the raised EVA metatarsal pad 22 (considered more fully below) are located on the footbed to effectively engage the typical locations of the origin and insertion of the plantar fascia (arch band) ligament of a wearer's foot. Data show that a generalized formula may be employed to locate the rounded rubber protrusion and the raised EVA metatarsal pad.

The outsole 24, also EVA or another suitably durable resilient material with comparable properties when employed in footwear, may be configured according to the market and uses to which the shoe may be put, above and beyond those of strictly therapeutic use. Accordingly, the outsole design shown in FIG. 3A is for purposes of illustration only. In an embodiment, textured lugs and flex grooves on the sole provide grip on wet/slippery surfaces.

Material choices complement the podiatric objectives of the shoe. For instance, the EVA footbed 12 is fabricated from EVA 55 shore C foam sheets; the footbed liner 12*a*, from EVA 35-40 shore C; the rounded rubber protrusion from 55-60 shore A; the two-ply strap from plastic (outer layer) and breathable mesh (inner layer).

Figure 4:
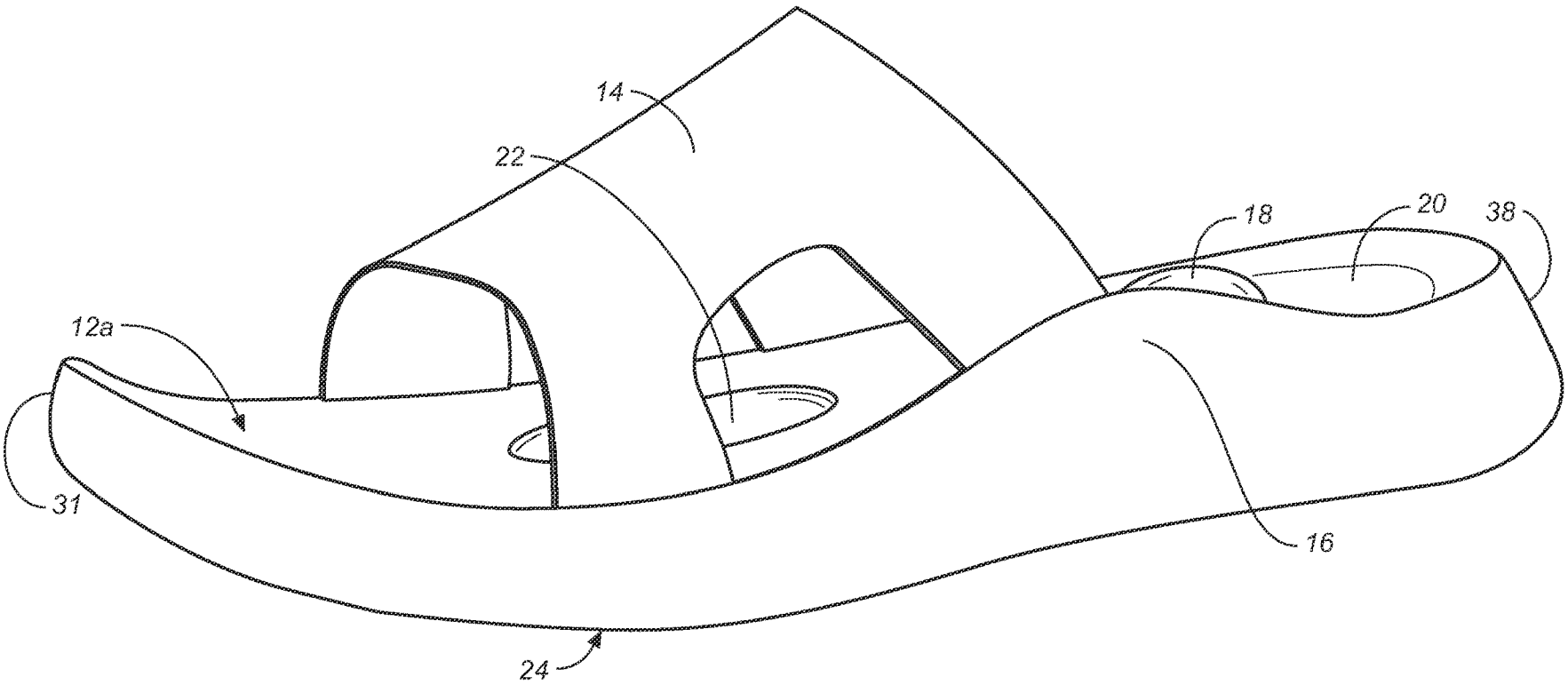
FIG. 4 is an upper left side perspective view thereof.

As will be appreciated, the strap configuration is also a matter of design choice, and an alternative design is shown in FIG. 4.

Figure 5:
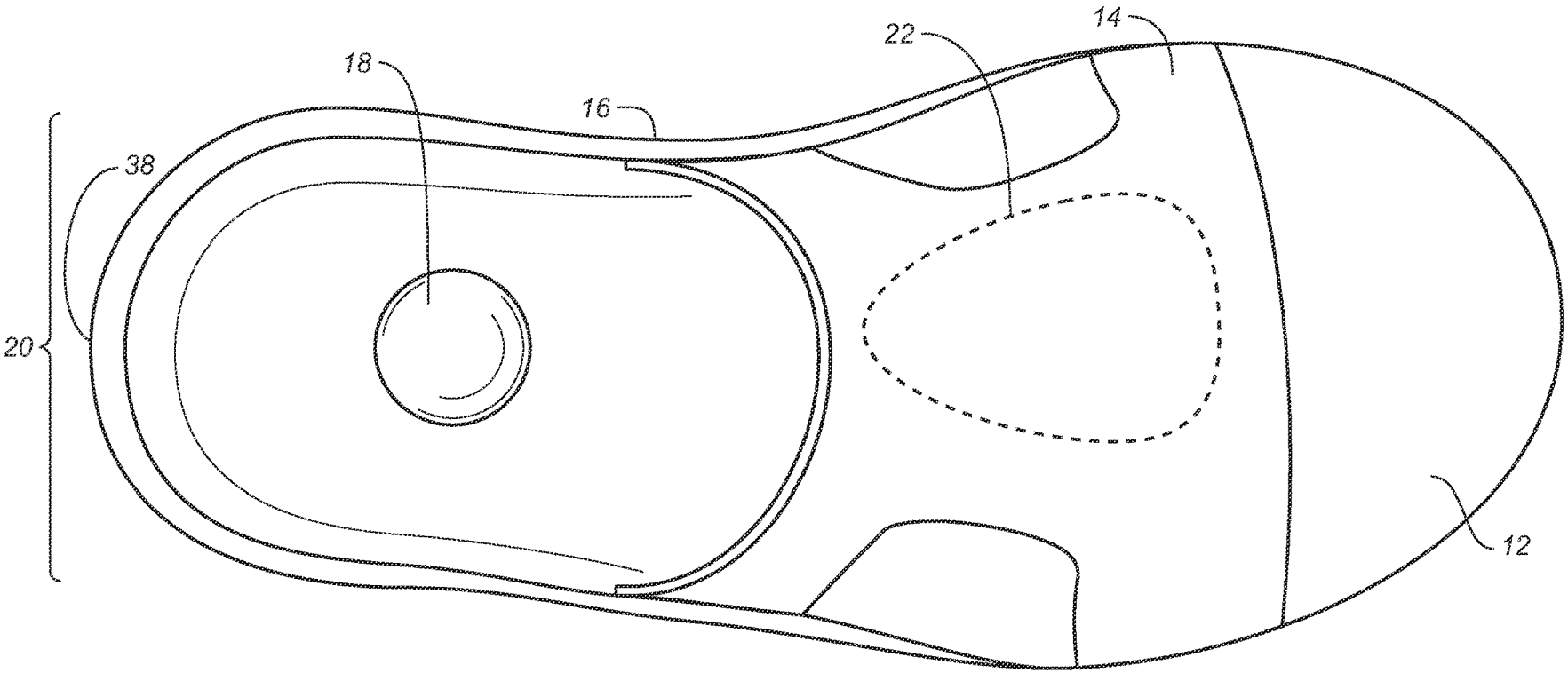
FIG. 5 is a highly schematic top plan view showing the footbed with podiatric features of the present invention.
Figure 6:
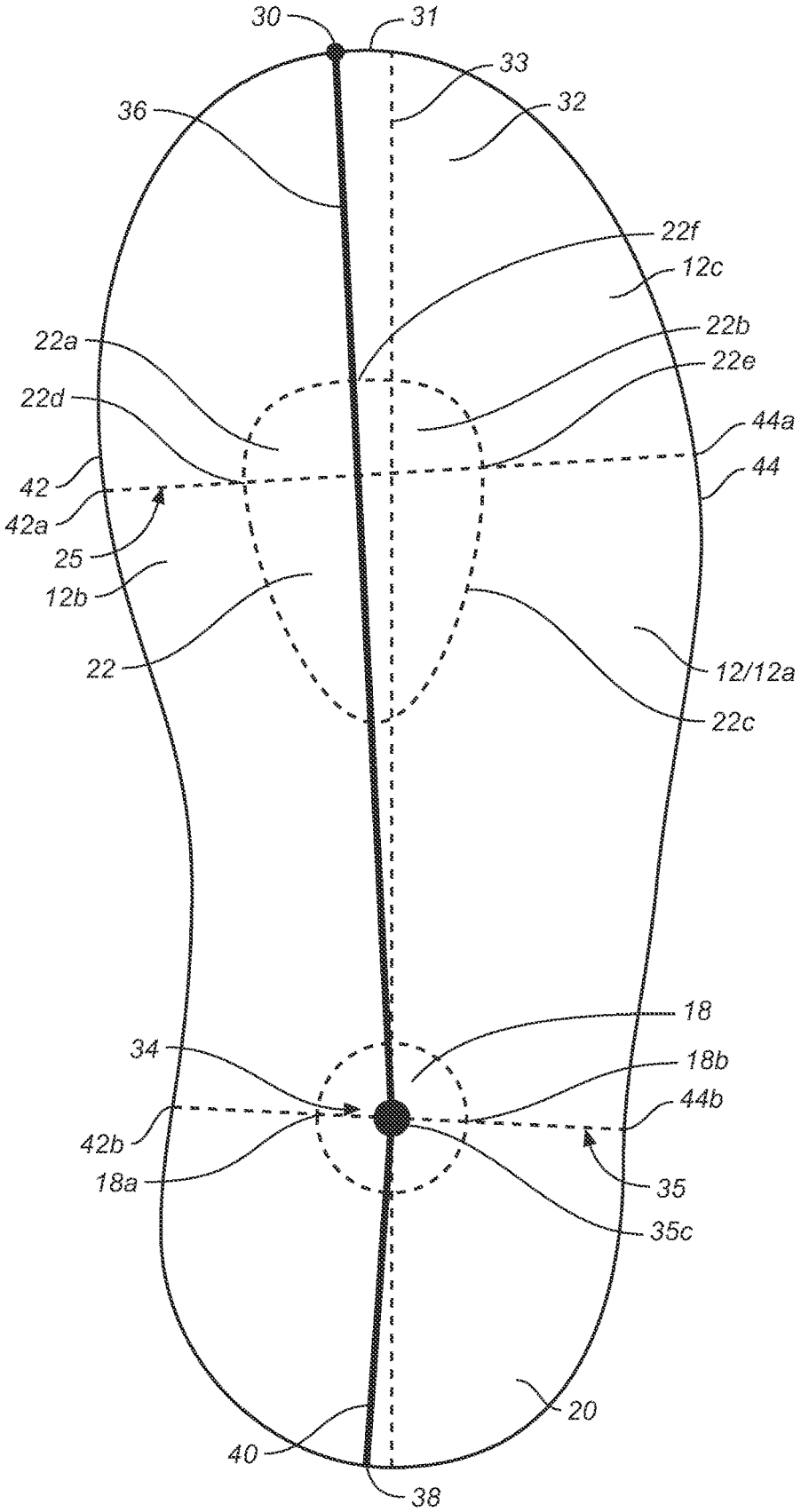
FIG. 6 is highly schematic top plan view showing how the massage elements are located on the footbed.

Referring next to FIGS. 5-6, the two features of the present invention distinguishing over prior art include the rounded rubber protrusion 18 and the raised EVA metatarsal pad 22. They are located on the footbed to conform to and engage via pressure the origin of the plantar fascia (arch band) at the medial calcaneal tubercle (heel bone) and the proximal phalanges of the toes at the metatarsophalangeal joints. These protrusions may be located at approximately the landmarks set out below, using centimeters as the unit of length and a US men's size 11 shoe as an exemplary size. Accordingly, placement of the rounded rubber protrusion 18 and EVA metatarsal pad 22 may be determined by calculating distances from footbed landmarks as a proportion of the distances set out for this exemplary US size 11 shoe (approximately 288 mm in length) and adjusted for size using the relative proportions of the various measurements. Placement specifications on a shoe footbed vary slightly according to footbed size (US men's whole sizes 6-13).

Referring now specifically to FIG. 6, for the raised EVA metatarsal pad 22, the measurement spans diagonally from the apex (uppermost point) 30 of the top edge 31 of the footbed toe 32 to the intersection point 34 on a functional midline, divided into a forefoot portion 36 and a hindfoot portion or heel portion 40 of the footbed 36, which together generally divides the footbed into medial and lateral sides 12*b*, 12*c*. Note should be made that the functional midlines 36/40 may depart from the true geometric longitudinal midline 33 by including a slight bend at the diagonal intersection point 34, the degree of bend depending on the degree of curvature in the shoe slide last, i.e., whether the last is a straight last, semi-curved last, or curved last. Measurements relating to the rounded rubber protrusion 18 are taken from the intersection point 34 on the footbed to the antapex 38 at the bottom edge 39 of the footbed heel 20 along the heel portion of the functional midline 40 which extends through the heel cup portion 20 of the footbed 12. Each of the metatarsal pad 22 and rounded rubber protrusion 18 are bifurcated by their respective functional midline portions 36/40.

The following specifications and dimensions are directed to the two differentiating features of the present invention: the raised EVA metatarsal pad and the rounded rubber protrusion.

Again, using a men's shoe size 11 as a basis for measurement, the diagonal intersection point 34 is about 17.7 cm from the top edge (toe) 30 of the footbed to intersection point 34 on the fore portion of the functional midline 36; 11.1 cm from the intersection point to the antapex 38 at the bottom edge 39 of the footbed (heel) on the heel portion of the functional midline 40, thus totaling the approximate 288 mm of a US size 11 shoe.

Using a right shoe/slide as a basis for measurement, and with all measurements taken along the functional midlines 36/40, in a top plan view the raised EVA metatarsal pad has a rounded triangle (akin to a guitar-pick or corn kernel shape), and it is about 5.7 cm in its longest dimension and 4.5 cm in width. It is divided into medial and lateral portions 22*a*, 22*b*, by the forefoot portion of the functional midline 36.

The circumferential edge or boundary 22*c* of the metatarsal pad 22 has an innermost point (i.e., a most medial point) 22*d* along the circumferential edge, an outermost point (most lateral point) 22*e* along the circumferential edge, and a foremost point 22*f* along the circumferential edge. Connecting the innermost point 22*d* and the outermost point 22*e* with a forefoot lateral line 25 normal to the functional midline, the innermost point 22*d* of the metatarsal pad may be positioned approximately 2 cm from the closest point 42*a* on the interior (medial) edge 42 of the footbed (or approximately 22% of the total width of the footbed at line 25), and the outermost point 22*e* may be positioned approximately 2.6 cm from the closest point on the exterior (lateral) edge 44*a* of the footbed (or approximately 28.6% of the width of the footbed at forefoot lateral line 25). Thus, the metatarsal pad itself is approximately 50% of the width of the footbed along line 25. It is approximately 10.3 cm from the apex 30 of the top edge 31 of the footbed as measured along the forefoot functional midline 36 (or 35.8% of the length of the functional midlines combined).

As shown in the views, the metatarsal pad extends as an elongate rounded triangular hemispherical dome from a cut out 22A in the EVA footbed liner and protrudes approximately 4 mm above the upper surface of the footbed liner (approximately 8 mm above footbed) with a 2 mm inward taper. [Note that the lateral dimensions use a standard medium width for a men's size 11 shoe. All measurements may be adjusted and thus calculated proportionally to size changes in both the length and width dimensions.]

Considered with the same bases for measurement, but with measurements taken along the heel portion of the functional midline 40, as well as a hindfoot lateral line 35 normal to the heel portion of the functional midline and extending through the center of the rounded rubber protrusion 18, the rounded rubber protrusion is a hemispherical element that may be approximately 2.3 cm in diameter, and it may be positioned 2.5 cm from the closest point 42*b* on the medial edge 42 of the footbed to the medial edge 18*a* of the protrusion (or approximately 33% of the width of the footbed at hindfoot lateral line 35), 2.7 cm from the lateral edge 18*b* of the rounded rubber protrusion 18 to the nearest point 44*b* of the lateral edge 44 of the footbed (or approximately 36% of the width of hindfoot lateral line 35). Thus, the rounded rubber protrusion comprises approximately 31% of the width of the footbed along hindfoot lateral line 35. and it extends through a cut-out of EVA footbed liner to project above the upper surface of the footbed at approximately 8 mm above the footbed liner (1.2 cm above the footbed) with a taper to 0 mm.

Still using the same bases for dimensions, additional diagonal measurements include: 3.7 cm from the bottom edge of the metatarsal pad to the rounded rubber protrusion along functional midline 36; it is 19.8 cm from the top edge of the footbed (where the functional midlines originate at the forefoot portion of the footbed, to the top edge of the rounded rubber protrusion 18.

Further measurements: The EVA footbed liner rises 4 mm above the EVA footbed (i.e., a thickness of approximately 4 mm); the raised arch extends to 2.5 cm above the 4 mm footbed liner (2.9 cm total above the footbed); the heel cup 20 rises 1.5 cm from the top of the footbed, not including the footbed liner. The strap dimensions vary according to footbed sizing. All sizes are approximate and may be tailored to the specific shore hardness of the materials and material layers to produce the desired therapeutic and prophylactic (injury/pathology prevention) effect.

The above disclosure is sufficient to enable one of ordinary skill in the art to practice the invention. While there is provided herein a full and complete disclosure of the preferred embodiments of this invention, this disclosure does not limit the invention to the exact construction, dimensional relationships, and operation shown and described. Various modifications, alternative constructions, changes, structural and material equivalents in properties and performance will readily occur to those skilled in the art and may be employed, as suitable, without departing from the true spirit and scope of the invention. Such changes might involve alternative materials, components, structural arrangements, sizes, shapes, forms, functions, operational features or the like.

What is claimed as invention is:

1. A shoe slide with podiatric elements, comprising:

a footbed having a forefoot area with a top edge, a hindfoot portion with a bottom edge, and a footbed surface;

a foam footbed liner insole disposed atop said footbed surface, said foam footbed liner having an upper surface;

a strap;

a metatarsal pad in said forefoot area of said footbed positioned and dimensioned such that when said shoe slide is worn said metatarsal pad engages and applies pressure to the wearer's plantar fascial near the proximal phalanges of the toes at the metatarsophalangeal joints;

a raised rubber protrusion in said hindfoot area of said footbed positioned so that when said shoe slide is worn said raised rubber protrusion engages and applies pressure to the wearer's plantar fascia near the calcaneal tubercle;

wherein said shoe slide has a functional midline that extends from said top edge to said bottom edge and divides said footbed into a medial portion having a medial edge and a lateral portion having a lateral edge and further has a forefoot portion and a heel portion defined by an intersection point corresponding to the center of said raised rubber protrusion; and wherein said functional midline bends at a center point of said raised rubber protrusion to form a forefoot portion and a heel portion to conform to the shape of the footbed last.

2. The shoe slide of claim 1, wherein said metatarsal pad is fabricated from ethylene-vinyl acetate (EVA).

3. The shoe slide of claim 2, wherein said metatarsal pad is fabricated from EVA 55 shore C.

4. The shoe slide of claim 1, wherein said raised rubber protrusion is fabricated from EVA.

5. The shoe slide of claim 4, wherein said raised rubber protrusion is fabricated from EVA 55-60 shore A.

6. The shoe slide of claim 1, wherein said footbed is a EVA foam footbed.

7. The shoe slide of claim 1, wherein said metatarsal pad is an elongate rounded triangular dome protruding from a cut out in said footbed liner and protruding approximately 4 mm above said upper surface of said footbed liner and approximately 8 mm above said upper surface of said footbed.

8. The shoe slide of claim 7, wherein said metatarsal pad has an approximate 2 mm inward taper.

9. The shoe slide of claim 8, wherein said metatarsal pad is approximately 5.7 cm in its longest dimension and 4.5 cm in width and is divided into medial and lateral portions by said forefoot portion of said functional midline.

10. The shoe slide of claim 9, wherein said metatarsal pad has an innermost point along a circumferential edge, and an outermost point along said circumferential edge, and further wherein connecting said innermost point and said outermost point with a lateral line normal to said functional midline, said innermost point is approximately 22% of the total width of the footbed at said lateral line, and said outermost point is approximately 28.6% of the width of the footbed at said lateral line.

11. The shoe slide of claim 9, wherein said metatarsal pad comprises approximately 50% of the width of said footbed along said lateral line.

12. The shoe slide of claim 9, wherein said metatarsal pad has a longitudinal dimension approximately 35.8% of the length of the forefoot portion and heel portion of the combined functional midlines.

13. The shoe slide of claim 1, wherein said raised rubber protrusion is hemispherical in shape, extends from said upper surface of said footbed from a cut out in said footbed liner.

14. The shoe slide of claim 13, wherein said raised rubber protrusion may be divided by a hindfoot lateral line normal to said heel portion of said functional midline, and wherein it is spaced from a medial edge of said footbed approximately 33% of the width of the footbed at said hindfoot lateral line and spaced from a lateral edge of said footbed approximately 36% of the width of the footbed at said hindfoot lateral line.

* * * * *